US008127480B1

(12) United States Patent
McManus et al.

(10) Patent No.: US 8,127,480 B1
(45) Date of Patent: Mar. 6, 2012

(54) MAGAZINE WELL EXTENSION FOR A FIREARM

(76) Inventors: Kasimere McManus, Quakertown, PA (US); Scott Vilardi, Alburtis, PA (US); Dean Deturk, Fleetwood, PA (US)

( * ) Notice: Subject to any disclaimer, the term of this patent is extended or adjusted under 35 U.S.C. 154(b) by 0 days.

(21) Appl. No.: 12/890,896

(22) Filed: Sep. 27, 2010

(51) Int. Cl.
*F41A 9/61* (2006.01)

(52) U.S. Cl. ..... 42/49.02

(58) Field of Classification Search ..... 42/49.02, 42/49.01, 50, 90, 6, 106
See application file for complete search history.

(56) References Cited

U.S. PATENT DOCUMENTS 2,926,448 A 3/1960 Stam
(Continued)

*Primary Examiner* — Bret Hayes
*Assistant Examiner* — Reginald Tillman, Jr.
(74) *Attorney, Agent, or Firm* — Gregory J. Gore

(57) ABSTRACT

A magazine well extension for a firearm having a magazine well and a trigger guard consists of a tapered monolithic hollow extension body closely matched to the magazine well opening. The bottom opening is larger than the top opening to more loosely receive the magazine for easier insertion. The extension is attached to the magazine well opening by upward facing rails on opposite sides at the top of the extension body which are matingly received by complimentary slots in the bottom of the magazine well. A second attachment point located at the rear of the extension includes a yoke which retains a laterally slidable captive pin that engages an outwardly extending tang on the trigger guard of the firearm. A forwardly extending lip at the front of the magazine well engages a groove on the inside wall of the extension to vertically support the extension at the front.

9 Claims, 4 Drawing Sheets

U.S. PATENT DOCUMENTS

| | | | | |
|---|---|---|---|---|
| 3,766,677 | A | 10/1973 | Waddell | |
| 4,654,993 | A | 4/1987 | Atchisson | |
| 5,452,534 | A | 9/1995 | Lambie | |
| 5,806,224 | A * | 9/1998 | Hager | 42/18 |
| 6,164,000 | A | 12/2000 | Lumplecker et al. | |
| 6,212,814 | B1 | 4/2001 | Lambie | |
| 6,739,082 | B2 | 5/2004 | Christensen | |
| 7,131,228 | B2 | 11/2006 | Hochstrate et al. | |
| 7,219,462 | B2 | 5/2007 | Finn | |
| 7,743,542 | B1 * | 6/2010 | Novak | 42/7 |
| 7,823,312 | B2 * | 11/2010 | Faifer | 42/49.02 |
| 2010/0154275 | A1 | 6/2010 | Faifer | |

* cited by examiner

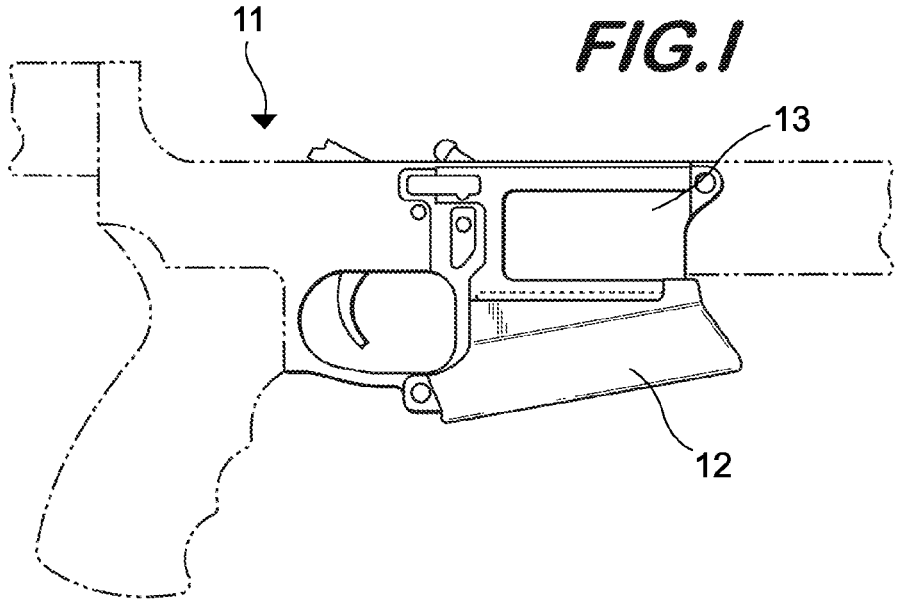
FIG.1
FIG.2
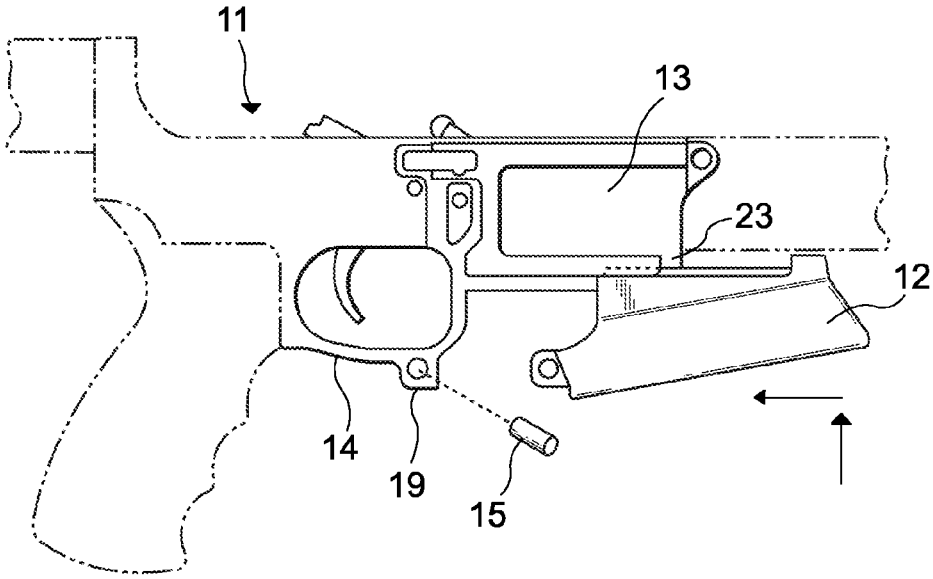

MAGAZINE WELL EXTENSION FOR A FIREARM

FIELD OF THE INVENTION

The present invention relates to ammunition-holding magazines for firearms such as the M-16, AR-15 or any other magazine feed military or sporting rifle. More specifically, it relates to a magazine well extension to increase the speed and ease of exchanging magazines.

BACKGROUND OF THE INVENTION AND PRIOR ART

Rifle magazines hold a supply of ammunition and are supported on the rifle by a magazine holder which has an opening that receives the magazine. When the ammunition in the magazine has been used up, the spent magazine is removed and a new fully loaded magazine is inserted into the magazine holder. The magazine receiving holder is typically referred to as a magazine well.

Loading the magazine into the rifle's magazine well requires skill and practice. The magazine wells of most rifles are only slightly larger than the magazine itself making reloading challenging. Thus, there have been attempts to make magazine reloading easier and faster. Improvements include magazine well extensions which have a wider mouth opening and a funnel-like tapered body that acts as a guide to feed the end of the magazine into the holder well. Having a larger opening at the mouth of the magazine extension makes replacing magazines much faster which can be critical in tactical operations. Certain types of sport shooting also benefit from fast rifle reloading.

Magazine well extensions of the prior art require tools to attach the extension to the magazine holder. For example, the magazine well extension produced by the Arrendondo Accessory Company of LaVerna, Calif. is made in two halves and uses fasteners to secure the two halves together. As it is attached, the top rim of the extension clamps against the flared end of the rifle magazine well. Screws between the two halves are then tightened to secure the magazine well extension in place. However, this assembly requiring screws and tools is particularly inconvenient and counter-productive when there is a need to quickly exchange magazine well extensions to achieve different performance capabilities.

Interchangeability of automatic rifle components without the need for tools is known as applied to modular firearms in which the major rifle components slide together and lock into place. An example of this type of modular rifle is disclosed in U.S. Pat. No. 7,131,228 issued to Hochstraight et al. entitled "Modular Firearm," however this firearm does not employ a magazine well extension and its magazine holder is affixed to the upper receiver and interchanged only to accommodate ammunition of different caliber. Because the magazine holder is a major component of the rifle, once the magazine well is removed, the firearm is no longer operative.

There is therefore a need in the art of firearms for an interchangeable magazine well extension which does not require tools to remove and attach and can be removed without destroying the operation of the firearm.

SUMMARY OF THE INVENTION

In order to meet the need in the art for an improved magazine well extension, the present invention has been devised. According to one embodiment of the invention, an easily exchanged magazine well extension has been created which does not require tool-driven fasteners to secure it in place.

This is achieved by providing the rifle with machined slots on the bottom of the magazine well and a pin attachment point on the trigger guard. The magazine extension has upward facing rails received by complimentary magazine well slots. In addition, a captive pin and yoke assembly on the back of the extension engage the pin attachment point on the rifle trigger guard. At a third point of attachment, a forward extending lip on the well engages a groove on the front inside wall of the extension. When applied to the firearm, the extension rails are first pressed up into the well slots and then slid rearwardly in the slots until the well front lip is fully engaged with a groove in the front of the extension thus stopping further movement. The extension locks into place on the trigger guard captured by a pin and yoke fastening means which align simultaneously with the full engagement of the well lip and the extension groove. Once installed, the extension attachment is rigid and the magazine well and the extension openings are precisely aligned. This embodiment of the present invention is particularly adaptable to the military and sporting rifles which utilize a detachable magazine. Examples of such weapons are AR-15, AR-10, M-4, M-16 SCAR, SIG 556 and HK416.

More specifically, the Applicant has devised a magazine well extension accessory for a fully functional firearm having a magazine well and a trigger guard comprising a tapered monolithic hollow extension having a body with two openings, one at each end. A first opening at the top end of the body is dimensioned to closely match the magazine well opening of the firearm. A second opening for loosely receiving a magazine of ammunition at the bottom end of the body is larger than the first opening. Upward facing rails on opposite sides of the body adjacent the first opening are slidingly and matingly received by complimentary slots in the bottom of the firearm magazine well on opposite sides. The extension may be easily removed or reattached to rigidly secure said first opening in alignment with the magazine well opening in the firearm.

The extension is attached to the well at three places. A first attachment point comprises slots on the well which capture interfitting rails on the extension body as described above. A second attachment point located at the rear of the extension body includes a yoke having two opposing laterally disposed arms which retain a laterally slidable captive pin. The yoke and pin assembly releasably engage an outwardly extending tang on the trigger guard of the firearm having a lateral throughbore. The yoke arms are dimensioned to closely receive the trigger guard tang between them. When the pin is inserted into the tang throughbore, the extension is locked into place and becomes rigidly affixed to the firearm. A spring loaded detent mechanism captivates the pin to the extension. The third point of attachment is provided by the above-described lip and groove attachment at the front abuttment interface of the well and the extension. Thus, the slots/rails secure the extension laterally while the combination of the lip/groove engagement and the pin/tang assembly capture the extension vertically and longitudinally.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 1 is a left side elevation view of the well extension of the invention with portions of the firearm to which it is attached shown in phantom.

FIG. 2 is a left side elevation assembly view.

DESCRIPTION OF THE PREFERRED EMBODIMENT

Figure 3:
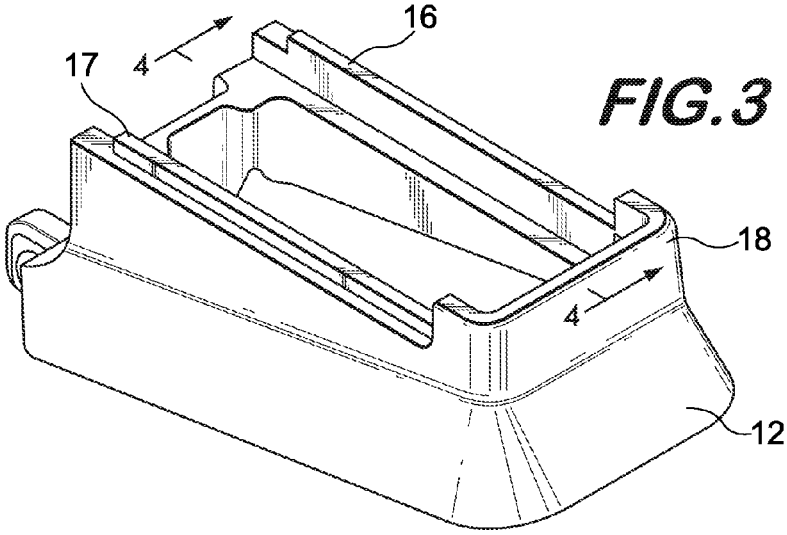
FIG. 3 is a top front right isometric view.

Referring now to FIGS. 1 and 2, the magazine well extension 12 of the present invention is shown assembled to a rifle 11 having a magazine well 13. The extension 12 is attached to the rifle as shown in FIG. 2 by first pressing the extension 12 upwardly into slots in the bottom of magazine well 13 and then sliding it rearwardly until a lip 23 at the front of the well engages the front of the extension. The extension 12 also attaches to the rifle trigger guard 14 by means of a tang 19 and a securing pin 15 which in FIG. 2 is depicted separated from the extension 12 for purposes of illustration although it is ordinarily captivated to the extension as shown in greater detail in FIG. 7.

Referring now to FIG. 3, the extension 12 includes upward facing rails 16 and 17 which extend from the top of the body of the extension. A front fender 18 acts as a stop against the magazine well to prevent further rearward movement of the extension when it is fully installed.

Figure 4:
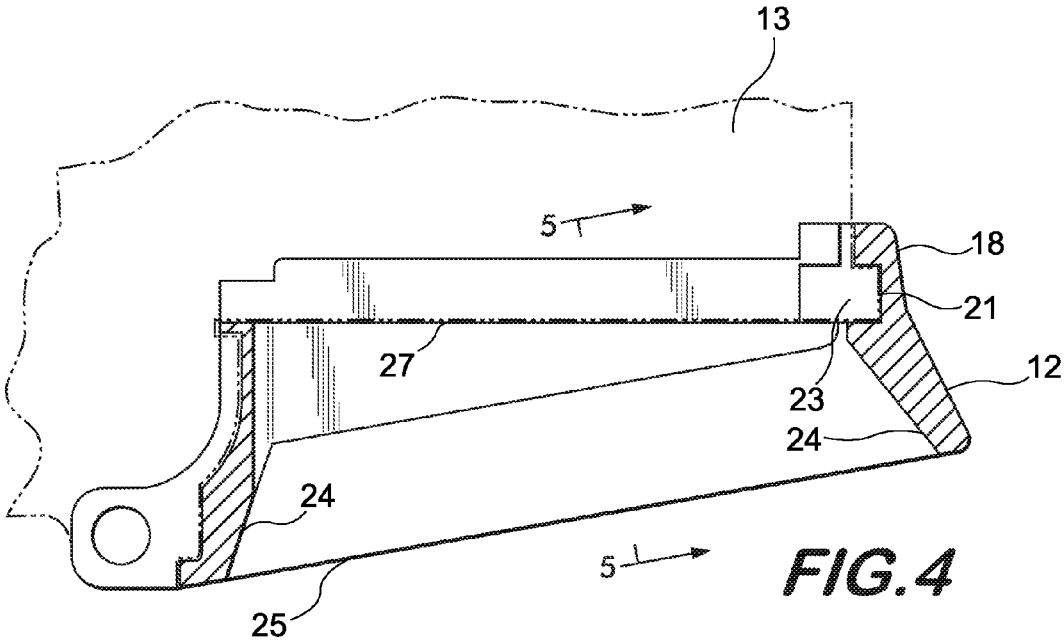
FIG. 4 is a left side sectional view taken from FIG. 3 as shown in that Figure.

Referring now to FIG. 4, the rifle magazine well is shown in phantom with the extension in its fully engaged position shown in FIG. 1. Here it can be seen that the inside wall of the fender portion 18 includes a groove 21 that receives a forwardly extending lip 23 that is integral with the front of the rifle magazine well. The extension 12 has a funnel-like tapered monolithic hollow body with an opening 25 at the bottom which is larger than an opening 27 at the top that is dimensioned to match the regular opening in the rifle magazine well 13. The tapered sidewalls 24 loosely receive and then guide the magazine into the opening of the magazine well as it is pressed upwardly through the extension.

Figure 5:
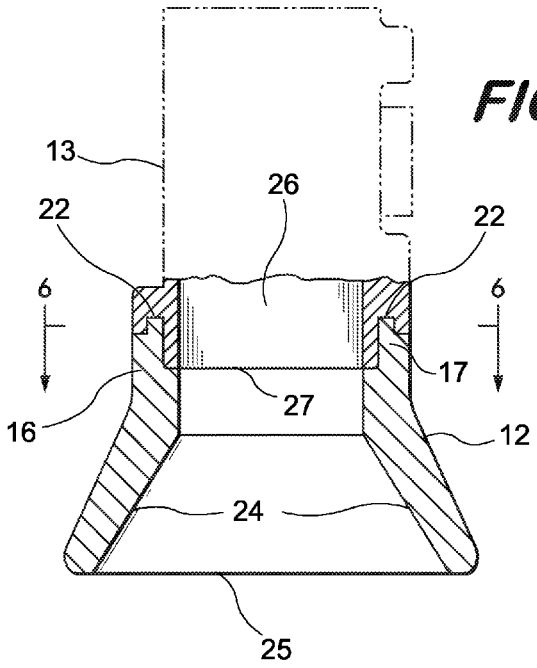
FIG. 5 is a rear sectional view taken from FIG. 4 as shown in that Figure.

Referring now to FIG. 5, the funnel-like tapered sides of the extension 12 are also clearly shown including the relationship between the larger receiving opening 25 at the bottom and the delivery opening 27 at the top with tapered sides 24 in between. It will be seen from this Figure that the top opening 27 matches the dimensions of the magazine well opening 26. The well includes slots 22 that receive the upwardly projecting rails 16 and 17 in close mating relationship.

Figure 6:
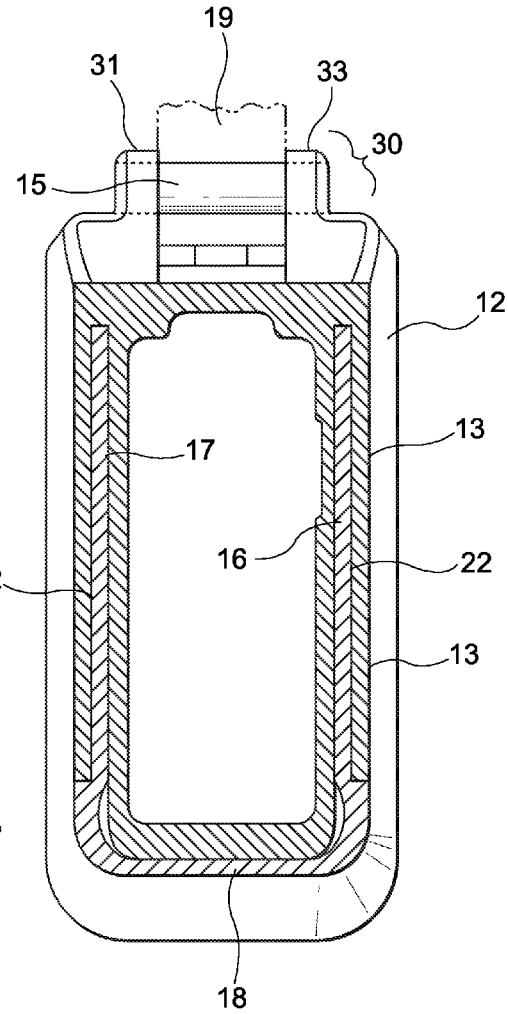
FIG. 6 is a top plan sectional view taken from FIG. 5 as shown in that Figure.

Referring now to FIG. 6, fender 18 of the extension acts as a stop abutting the front side of the well 13 when the extension is fully installed. The well slots 22 are parallel and closely receive the parallel rails 16 and 17. It will be well understood by those of skill in the mechanical arts that this structure as shown in the foregoing drawings permits the upwardly insertable and rearwardly slidable relationship between the magazine well 13 and the extension 12. At the rear of the extension is a yoke and pin assembly that comprises laterally disposed opposing arms 31 and 33 which closely receive a tang 19 that extends outwardly from the trigger guard. The pin completes the assembly extending through aligned holes in the yoke arms and a throughbore in tang 19 as further depicted in FIG. 7.

Figure 7:
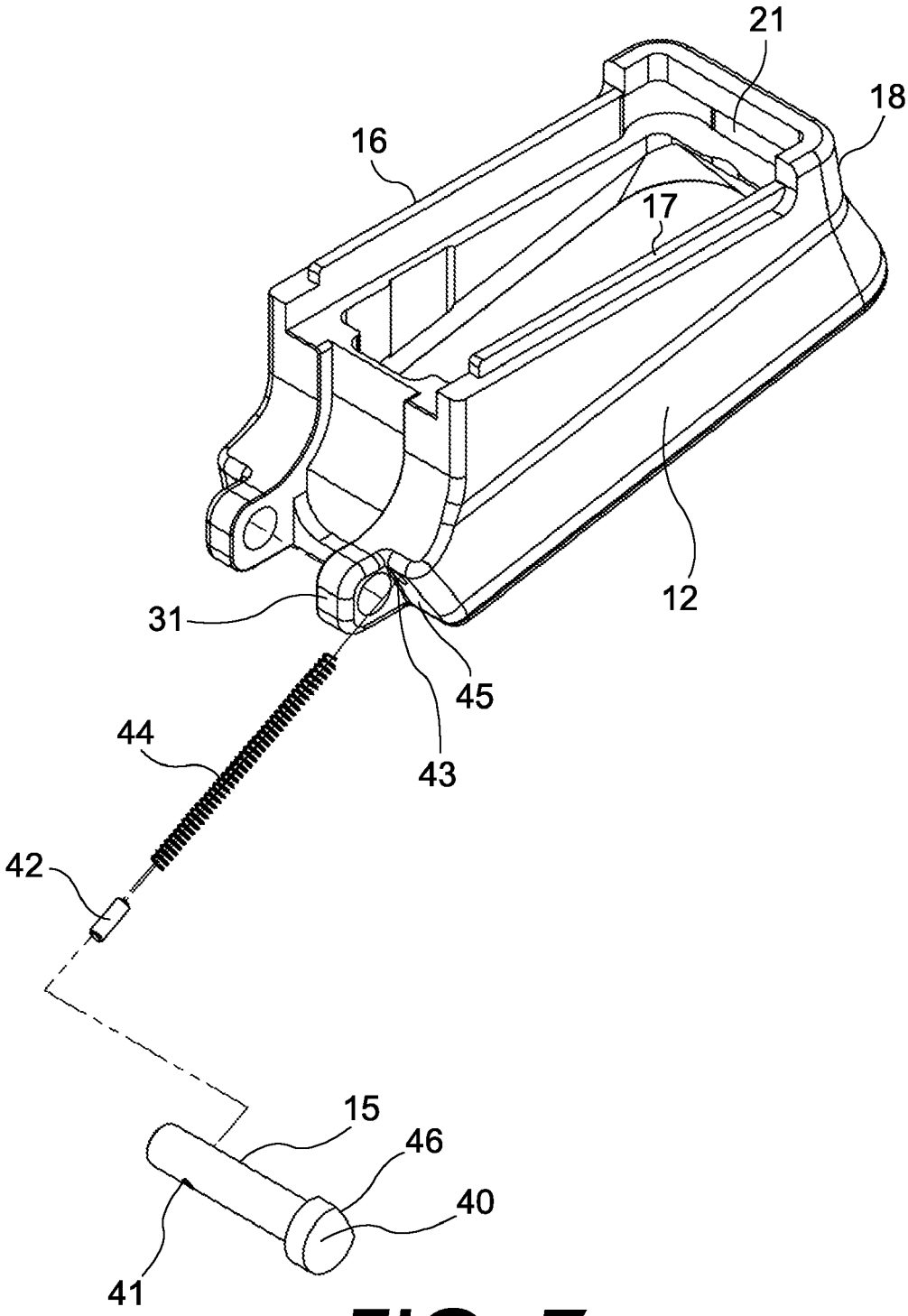
FIG. 7 is a top left rear isometric assembly view.

Referring now to FIG. 7, details of the pin and yoke assembly of the extension 12 are further shown. Pin 15 has a head 40 at one end and a forward facing detent 41 adjacent its opposite end shown from the rear in this view. The detent cooperates with a spring 44 and cylinder 42 that are fitted into a recess 43 in the extension 12. By these mechanical relations, the pin 15 is manually moveable between two stable positions, one in which the pin head 40 abuts the outside of yoke arm 31 at full engagement and a retracted position where the pin is captivated to the extension being held within yoke arm 31 by means of the cylinder 42 occupying the detent 41. A flat 46 on one side of the pin head is in near abutment with the outer surface 45 of the extension to ensure radial alignment with the cylinder and detent so that those two parts will engage when the pin is pulled straight out laterally. The retracted position of the pin is stable being held there from falling free of the extension by the detent mechanism. Also seen from the view depicted in FIG. 7 are the rails 16 and 17 along the parallel top edges of the extension 12. The fender 18 which extends upwardly above the rails includes the groove 21 along its inside wall.

From the foregoing mechanical relations, it will be appreciated that a no-tools-needed attachment of a magazine well extension to a firearm has been achieved. The embodiments shown in FIGS. 1-7 provide an extension which is easily handled and can be quickly removed and reattached or exchanged for a different extension. The ease and speed of using the extension is owing to the simple compound up-and-back movement provided by its various attachment structures. The rails do not need to be end-inserted into the slots but are engaged by a simple direct upward movement. Therefore, the magazine well may be attached with one hand by feel and without direct eyesight while the other hand supports the rifle.

Thus it may be appreciated to those of skill in the art that the advantages of the invention have been achieved from the embodiments of the preferred invention shown. Also, it should be understood that there may be other modifications and changes to the present invention that will be obvious to those of skill in the art from the foregoing description, however, the present invention should be limited only by the following claims and their legal equivalents.

What is claimed is:

1. A magazine well extension accessory for a fully functional firearm having a magazine well and a trigger guard, comprising:

a monolithic tapered hollow extension body having two openings, one at each end;

the first opening at a top end of said body that is dimensioned to closely match a magazine well opening in said firearm;

the second opening for loosely receiving a magazine of ammunition at a bottom end of said body that is larger than said first opening;

two parallel rails on opposite sides of said body adjacent said first opening for slidable engagement with slots on the bottom side of said firearm magazine well; and means for attachment at a rear side of said extension body for releasably engaging means for cooperating attachment on the outside of the trigger guard of said firearm when said extension is in a fully engaged position, said extension being manually selectively attachable without the use of tools from a removed position to the fully engaged position where said first opening is in close alignment with said magazine well opening in said firearm.

2. The magazine well extension of claim 1 further including a rearward facing groove on a front inside wall of said extension for engaging a forwardly extending lip at the front of said well.

3. The magazine well extension of claim 2 wherein said means for cooperating attachment on the trigger guard is an outwardly extending tang having a lateral throughbore.

4. The magazine well extension of claim 3 wherein said means for attachment comprises a yoke having two opposing laterally disposed arms which retain a laterally slidable captive pin, said arms being dimensioned to closely receive the firearm trigger guard tang there between, said means for attachment being in a locked position when said pin is inserted into said tang throughbore thereby rigidly affixing the extension body to the firearm.

5. The magazine well extension of claim 4 wherein said firearm is a rifle.

6. The magazine well extension of claim 4 wherein said pin is captivated to one arm of the yoke.

7. The magazine well extension of claim 6 wherein said pin is captivated by the engagement between a spring-biased cylinder held within said extension and a detent in said pin.

8. The combination comprising the magazine well extension of claim 6 and a rifle, said rifle having slots on a bottom side of a firearm magazine well, a trigger guard with an outwardly extending tang having a lateral throughbore and a forwardly extending lip at the front of said magazine well whereby said magazine well extension can be removed from said rifle without tools, said rifle remaining functional after removal of said magazine well extension.

9. The magazine well extension of claim 2 further including an upwardly extending fender at the front of said extension that extends to a point higher than said rails, said groove lying along an inside wall of said fender.

* * * * *